US007656370B2

(12) United States Patent
Schneider et al.

(10) Patent No.: US 7,656,370 B2
(45) Date of Patent: Feb. 2, 2010

(54) METHOD AND CIRCUIT ARRANGEMENT FOR THE AGEING COMPENSATION OF AN ORGANIC LIGHT-EMITTING DIODE AND CIRCUIT ARRANGEMENT

(75) Inventors: Oliver Schneider, Dresden (DE); Jan Birnstock, Dresden (DE)

(73) Assignee: Novaled AG, Dresden (DE)

( * ) Notice: Subject to any disclaimer, the term of this patent is extended or adjusted under 35 U.S.C. 154(b) by 541 days.

(21) Appl. No.: 11/231,329

(22) Filed: Sep. 20, 2005

(65) Prior Publication Data

US 2006/0214888 A1 Sep. 28, 2006

(30) Foreign Application Priority Data

Sep. 20, 2004 (DE) ..... 10 2004 045 871

(51) Int. Cl.
*G09G 3/32* (2006.01)

(52) U.S. Cl. ..... 345/82; 345/204; 345/211

(58) Field of Classification Search ..... 345/82–83, 345/204, 211, 76, 214
See application file for complete search history.

(56) References Cited

U.S. PATENT DOCUMENTS

| | | | | |
|---|---|---|---|---|
| 6,414,661 | B1 | 7/2002 | Shen et al. | |
| 2003/0122813 | A1 | 7/2003 | Ishizuki et al. | |
| 2003/0146888 | A1 | 8/2003 | Yamazaki et al. | |
| 2004/0070558 | A1 | 4/2004 | Cok et al. | |
| 2005/0280766 | A1 * | 12/2005 | Johnson et al. | 349/167 |
| 2006/0044227 | A1 * | 3/2006 | Hadcock | 345/76 |

FOREIGN PATENT DOCUMENTS

| | | | |
|---|---|---|---|
| DE | 10 09 204 | A1 | 8/2001 |
| EP | 1282101 | A1 | 2/2003 |
| EP | 1 318 499 | A2 | 6/2003 |
| WO | 01/27910 | A1 | 4/2001 |
| WO | 2004025615 | A1 | 3/2004 |

OTHER PUBLICATIONS

Du-Zen Peng et al, P-134: Novel Pixel Compensation Circuit for AMOLED Display, 2005 SID International Symposium, SID 05 Digest, San Jose, CA. May 24, 2005, pp. 814-817.

* cited by examiner

*Primary Examiner*—Amare Mengistu
*Assistant Examiner*—Hong Zhou
(74) *Attorney, Agent, or Firm*—Sutherland, Asbill and Brennan, LLC

(57) ABSTRACT

The invention relates to a method and a circuit arrangement for the ageing compensation of an organic light-emitting diode (OLED) which is fed from a supply voltage and is switched by means of a driver transistor operated in saturation operation, by means of a driving of the light-emitting diode. The method comprises the following steps of: storing at least one desired current-voltage value pair of a desired current-voltage characteristic curve of the light-emitting diode; transferring the driver transistor from saturation operation to linear operation during a measurement cycle; measuring a current value for the current through the light-emitting diode by means of a current measuring circuit in the measurement cycle; determining at least one present current-voltage value pair of a present current-voltage characteristic curve of the light-emitting diode by means of the measured current value; comparing the at least one present current-voltage value pair of the light-emitting diode with the desired current-voltage value pair of the light-emitting diode; and generating driving parameters for driving the light-emitting diode in a manner dependent on the result of the comparison.

14 Claims, 4 Drawing Sheets

Relationship of operating voltage and luminous intensity

METHOD AND CIRCUIT ARRANGEMENT FOR THE AGEING COMPENSATION OF AN ORGANIC LIGHT-EMITTING DIODE AND CIRCUIT ARRANGEMENT

CROSS-REFERENCE TO RELATED APPLICATIONS

Applicants hereby claim priority under 35 U.S.C. 119(a) to German Patent Application No. 10 2004 045 871.5, filed Sep. 20, 2004.

The invention relates to a method for the ageing compensation of an organic light-emitting diode (OLED) and a circuit arrangement.

BACKGROUND OF THE INVENTION

Organic light-emitting diodes, so-called OLEDs, have a forward current flowing through them during operation in the forward direction and exhibit electroluminescence phenomena in the process. In this case, the intensity of the electroluminescence is dependent on the magnitude of the forward current.

OLEDs usually have the disadvantage that ageing occurs, in the course of which the intensity of the electroluminescence decreases for the same forward current. Said ageing is accompanied by an increase in the forward resistance of the OLED. Corresponding behaviour is exhibited by a forward voltage dropped across the OLED given the same current. With the current flow remaining the same, said forward voltage rises with advancing ageing of the OLED. To put it in more general terms, the characteristic curve of an OLED is altered with advancing ageing. The ageing of the OLED can be regarded as a state which can bring about the same state of ageing independently of the type of current that flowed previously. In this case, a short high current flow leads to the same state as a long low current flow. There is the same situation concerning the behaviour of the image contents displayed on a display. A pixel which has been driven very bright for a short time attains the same state as a pixel which has been operated with low brightness for a long time. Therefore, the driving can be corrected correspondingly given knowledge of the ageing state.

A display can be formed from many OLEDs which have an individual ageing behaviour depending on the information represented.

The document US 2004/0070558 A1 describes an OLED display comprising OLED pixels which are controlled by means of a control circuit. The display comprises an OLED reference pixel, the voltage drop of which is determined by means of a measuring circuit. The measuring circuit is connected to an evaluation circuit, which generates a feedback signal as a reaction to the behaviour of the reference pixel. The feedback signal is fed to the control circuit in order that the latter can compensate for changes in the behaviour of the OLED pixels.

The document EP 1 318 499 A2 discloses an OLED display having a current source for generating a reference current and a driver transistor for controlling the OLED pixels. In one embodiment, the current source generates a current in a manner dependent on a luminosity setting signal of the display in order to set the total luminous intensity of the display.

The document US 2003/0122813 A1 discloses a method for controlling an OLED display. The method involves applying voltages for driving OLED pixels of the display. In order to compensate for the change in luminosity of the individual OLED pixels, the OLED pixels are driven individually and the current flowing through them is measured for each pixel and stored. Afterwards, the voltages present at the OLED pixels are controlled in accordance with the stored current values.

The document US 2003/0146888 A1 describes an OLED display that can be operated in two different modes. In a first mode, the OLED display is operated by means of a constant voltage, while in the second mode a constant current is used for this purpose.

The document DE 100 09 204 A1 describes a method for driving actively addressed OLED displays in which the current-voltage characteristic curves of the pixels are measured. The data of the current-voltage characteristic curve are written to a memory. If the current-voltage characteristic curves deviate from the ideal characteristic curve, then the image information stored in the image memory is correspondingly manipulated in order that the same brightness appears on the display despite the ageing of individual pixels.

For measuring the current-voltage characteristic curves, the column drivers of the display matrix are provided with measuring devices. The hardware outlay of the arrangement increases considerably in this case. The way in which the current-voltage characteristic curves of the pixels are measured is not described and is not obvious to the person skilled in the art.

OBJECT OF THE INVENTION

Consequently, the invention is based on the object of specifying a method for the ageing compensation of an organic light-emitting diode and a circuit arrangement in the case of which the outlay, in particular the circuitry outlay, can be minimized.

SUMMARY OF THE INVENTION

The object is achieved according to the invention by a method according to the independent claim 1 and a circuit arrangement according to the independent claim 11. Advantageous refinements of the invention are the subject-matter of dependent subclaims.

The invention is based on the idea of storing at least one known current-voltage value pair of the OLED at an instant of little ageing. During a measurement cycle, the driver transistor is brought from saturation operation to linear operation. In linear operation, the present current-voltage value pair of the OLED can be determined and be compared with the known current-voltage value pair of the unaged OLED, which is also referred to as desired current-voltage value pair. The driving of the OLED is then effected whilst taking account of the difference between the present current-voltage value pair and the known current-voltage value pair.

A preferred embodiment of the invention provides for the OLED with its driver transistor to be used in a display matrix in which a plurality of OLEDs are arranged and which is fed via a display supply line, so that the method for ageing compensation is implemented in the display matrix.

By means of the known characteristic curve of the driver transistor, the present parameters of each individual OLED can be determined using a single current measuring circuit, which measures the current through the supply voltage terminal $V_{DD}$ of the display, for the entire display. If only a single OLED in the display matrix is turned on, the current flowing through this OLED and the associated driver transistor is equal to the current measured by the current measuring circuit minus the dark current of the display, which is measured when all the OLEDs are switched off. Said dark current is brought about by the leakage currents of the transistors of the matrix. By way of the measured OLED current and the calculated OLED voltage, the characteristic curve of the OLED that is associated with the present ageing state can be identified and the ageing state can thus be determined.

It is known what effects the ageing state has on the function of the OLED, for example the magnitude of a reduction of luminance. Furthermore, the measures leading to a compensation are known. These may be stored in a table, in a display controller for example, and be correspondingly called up and set.

In the case of the method it may furthermore be provided that the driving parameters that were determined whilst taking account of the difference between the present current-voltage value pair and the known current-voltage value pair are stored in a memory until the ageing is determined anew. Various solutions for retaining the compensating settings are possible, in principle. The storage of the values determined represents a variant exhibiting little complexity in this case, however.

One embodiment of the method serves for determining, in an additional method step, the threshold voltage of the driver transistors if it is not known. In this case, it is provided that

- all OLEDs of the matrix are switched off in a measurement cycle,
- the total current $I_{Doff}$ of the matrix through the display supply line is measured,
- afterwards, apart from one pair to be measured comprising one of the OLEDs and its associated driver transistor, all other corresponding pairs are switched off,
- two measurements of the current in saturation operation of the driver transistor, $I_{Don1}$ and $I_{Don2}$, at two different gate voltages $U_{GS1}$ and $U_{GS2}$, are carried out, and
- the threshold voltage of the driver transistor is calculated from the currents $I_{Doff}$, $I_{Don1}$, and $I_{Don2}$ and the gate voltages $U_{GS1}$ and $U_{GS2}$.

A development provides for the supply voltage $V_{DD}$ of the display to be reduced to an extent such that the driver transistors no longer operate in saturation operation, but rather in linear operation. Apart from the OLED to be measured, all other OLEDs are then switched off and the source-drain current $I_D$ of the driver transistor of the OLED to be measured is measured via the display supply line. The source-drain voltage of the driver transistor is determined by means of the characteristic curve of said driver transistor, the gate voltage and the measured source-drain current. A forward voltage value of the OLED is calculated from the difference between the supply voltage and the calculated source-drain voltage. The characteristic curve alteration is finally determined from the comparison of the value pair comprising present OLED current and present OLED voltage with a desired current-voltage characteristic curve.

As an alternative, a further embodiment of the method provides for the supply voltage $V_{DD}$ to once again be reduced to an extent such that the driver transistor is brought from saturation operation to linear operation. Firstly all OLEDs of the matrix are switched off and a dark current $I_{Doff}$ through the display supply terminal is measured. Afterwards only the OLED to be measured is switched on and a current $I_{Don}$ is measured and the source-drain current of the driver transistor $I_D$ is calculated from the difference between $I_{Don}$ and $I_{Doff}$. The source-drain voltage of the driver transistor is determined by means of the characteristic curve of said driver transistor, the gate voltage and the calculated source-drain current. A forward voltage value of the OLED is calculated from the difference between the supply voltage and the calculated source-drain voltage. The characteristic curve alteration is finally determined from the comparison of the value pair comprising present OLED current and present OLED voltage with a desired current-voltage characteristic curve.

A measurement cycle for an OLED then typically comprises a first measurement of the current with all the OLEDs switched off and a second measurement, in the course of which only the respective OLED is turned on. The current that flowed only through this OLED is thus obtained from the difference. Leakage currents of the other pixels are no longer significant.

By means of the characteristic curve of the driver transistor, the source-drain voltage of the driver transistor is calculated from the OLED current and the gate voltage at said driver transistor.

The voltage present at the OLED is determined from the difference between the supply voltage and the source-drain voltage in the turned-on state.

The voltage increase and thus the ageing state of the OLED can be determined from the value pair comprising the present OLED current and the present OLED voltage and the known initial OLED characteristic curve.

One development of the method provides for multiple application of the method, in which case, either with alteration of the gate voltage of the driver transistor, a characteristic curve segment of the OLED characteristic curve is recorded and this characteristic curve segment is subsequently used for more precise compensation of the ageing, or, with alteration of the supply voltage of the display $V_{DD}$, a characteristic curve segment of the OLED characteristic curve is recorded and this characteristic curve segment is subsequently used for more precise compensation of the ageing.

The method described can be performed for any OLED of the display and the present ageing state can be stored in a memory. In this case, the display is scanned OLED by OLED. This may be effected e.g. at time intervals or else upon every turn-on.

The stored ageing states are then used to compensate for the ageing of the OLED either in an analogue manner, for example by means of an altered reference voltage from which the control voltage for the respective brightness values is generated, or in a digital manner, by calculation of a corrected brightness value. Consequently, it is possible to carry out a brightness compensation of the aged OLED and/or a gamma correction adaptation of the matrix.

The circuit arrangement according to the invention provides for a current measurement to be connected into the current path. The method explained above can be carried out in a simple manner by means of this current measuring circuit.

One embodiment of the circuit arrangement provides for the current measuring circuit to be arranged between the terminal of the supply voltage $V_{DD}$ and the OLED.

The invention can be used for ageing compensation in a wide variety of applications of OLEDs. One possibility of use constitutes a display matrix within which a multiplicity of luminous or display elements are arranged which are formed by the circuit, comprising OLED, driver transistor and driving transistor. In this case, it is provided that the circuit is arranged multiply in rows and columns of a display matrix, all these circuits having a column connection to the supply voltage $V_{DD}$. For the application of the method according to the invention, it is provided in this case that the current measuring circuit is located in the common connection of the circuits to the supply voltage $V_{DD}$.

Two mutually alternative expedient embodiments of the circuit arrangement consist in the spatial arrangement of the current measuring circuit, namely firstly in or at the driving circuit or on the substrate of the display matrix.

PREFERRED EXEMPLARY EMBODIMENTS OF THE INVENTION

The invention will be explained in more detail below on the basis of exemplary embodiments with reference to figures of a drawing, in which.

Figure 1:
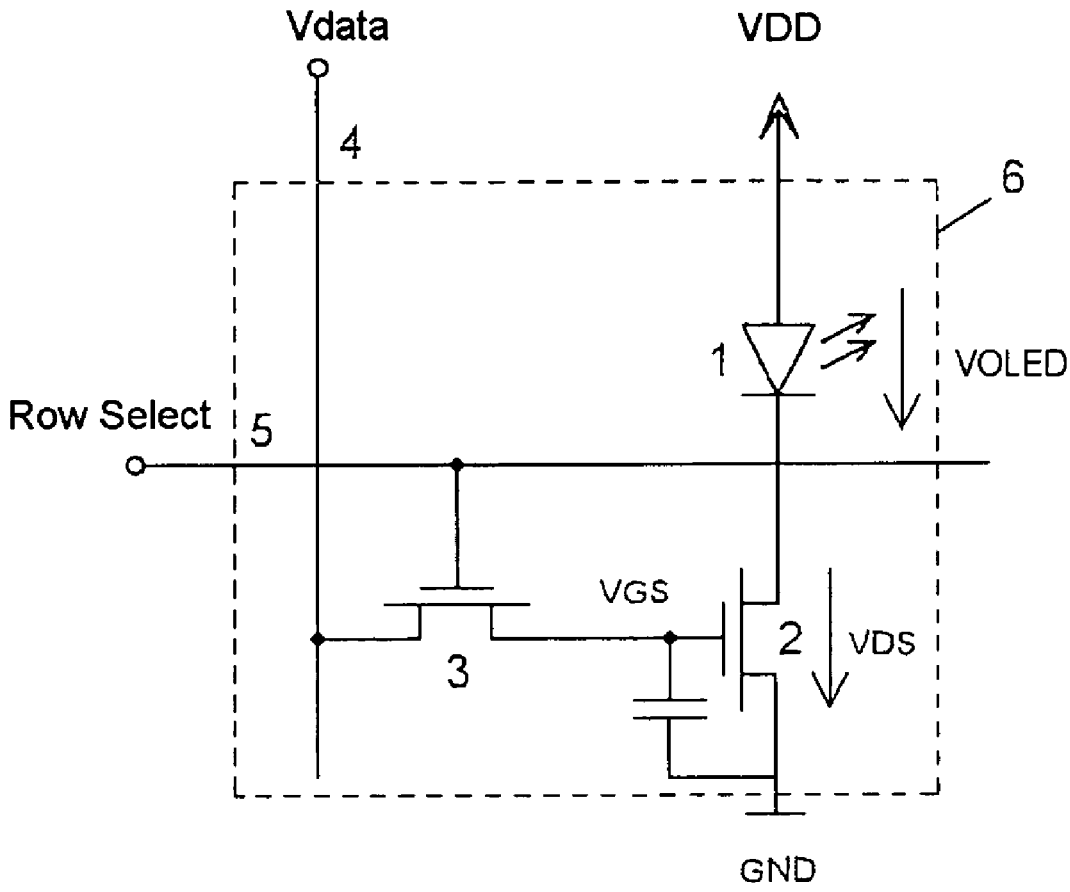
FIG. 1 shows a circuit arrangement of an OLED as a pixel in a display matrix with a driver transistor.

As illustrated in FIG. 1, an OLED 1 is situated in a current path together with the drain-source path of a driver transistor 2 between a supply voltage $V_{DD}$ and earth. The gate of the driver transistor 2 is connected to a driving transistor 3. Upon selection of the pixel in the display which is formed by the OLED 1, a data voltage $V_{Data}$ is present on the data line 4 and a row voltage $V_{Row}$ is present on the row select line 5, as a result of which the driver transistor 2 acquires a gate voltage $V_{GS}$.

Figure 2:
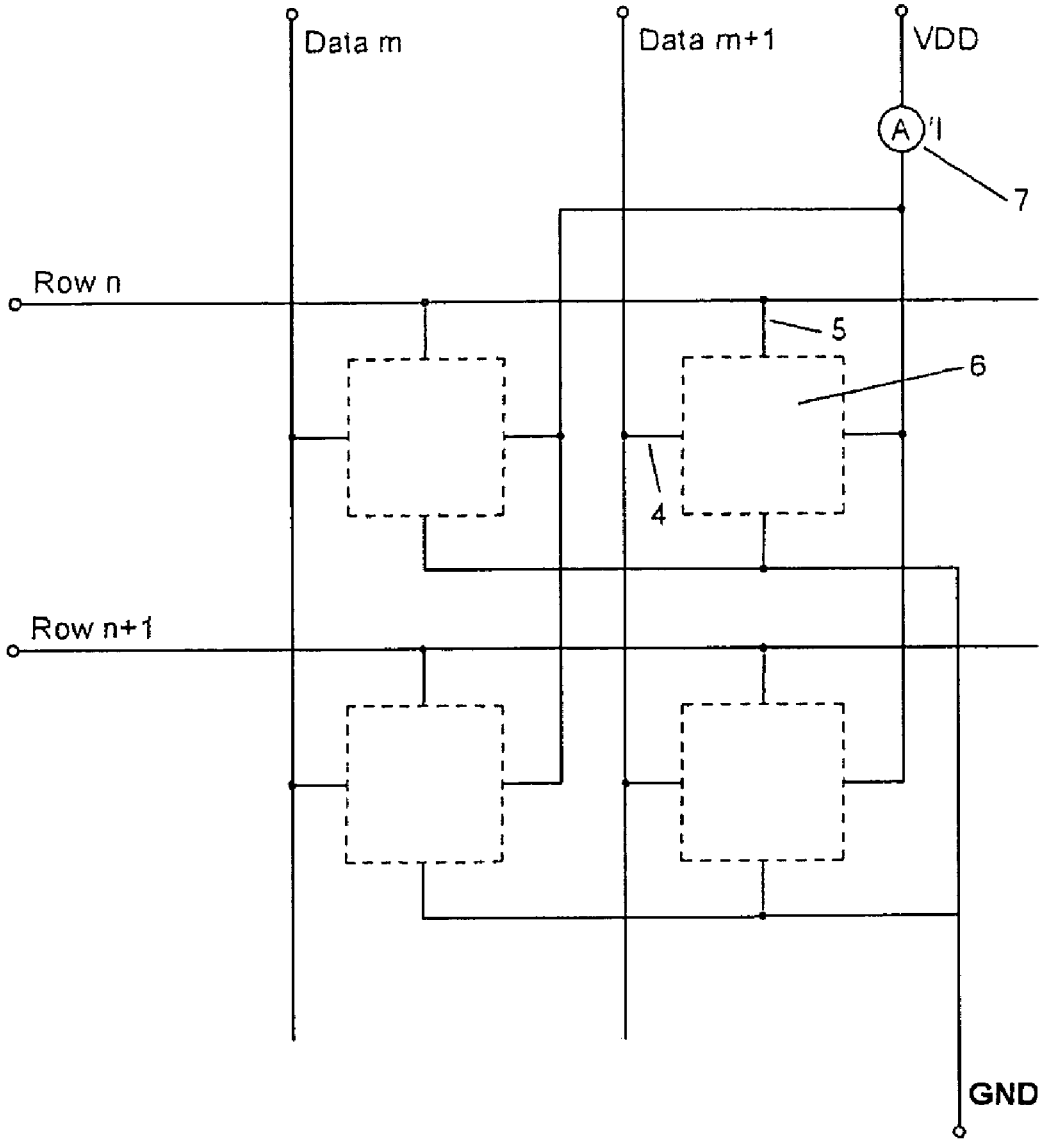
FIG. 2 shows a simplified illustration of a pixel matrix with a current measuring circuit.

FIG. 2 illustrates a detail from an OLED display matrix. Two times two OLEDs are illustrated by way of example, the hatched region representing a circuit 6 according to FIG. 1 in a simplified manner. The figure shows how the current measuring circuit 7 is integrated into the supply line of the display matrix and measures the total current of the display through all the pixels.

Figure 3:
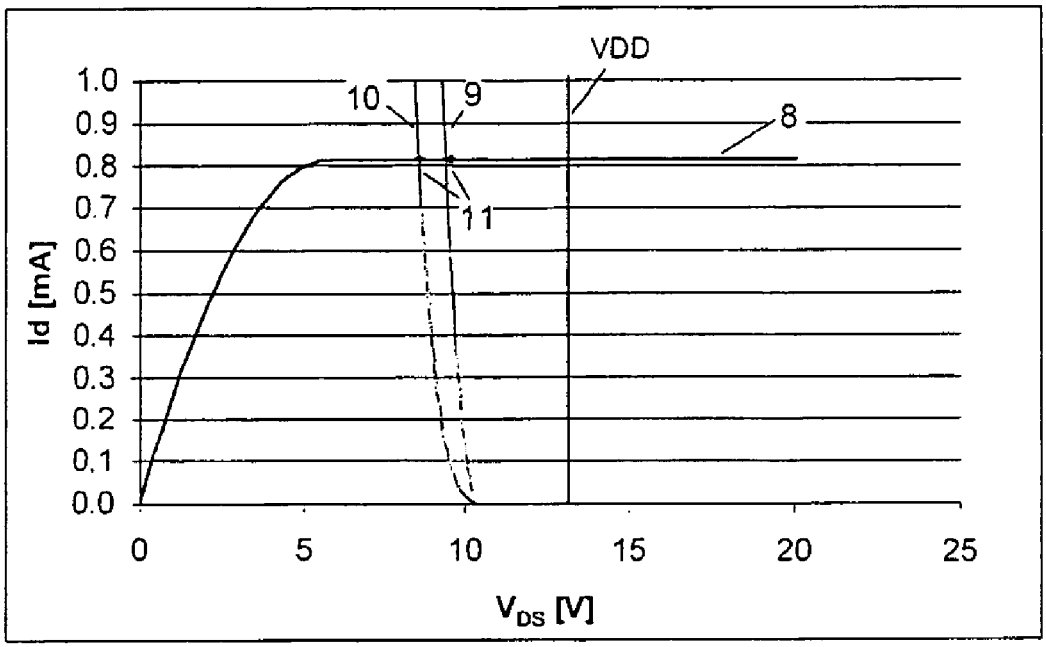
FIG. 3 shows a characteristic curve of a driver transistor in saturation operation.

As illustrated in FIG. 3, in normal operation the supply voltage $V_{DD}$ is chosen such that the driver transistor 2 operates in saturation operation, that is to say, upon application of a gate voltage $V_{GS}$, drives a current independent of the OLED voltage through this.

FIG. 3 also illustrates the characteristic curve 9 of the OLED 1 in the little-aged state, preferably in the production state, also referred to here as the known or desired state, and also the characteristic curve 10 of the OLED 1 in the aged state. This state represents the present state in the context of the intended ageing compensation. Upon the activation of the driver transistor 2, a current equal to the current $I_D$ through the OLED 1 is then established through the drain-source path of the driver transistor 2. This current is always the same, in accordance with FIG. 3, in the aged and also in the non-aged state of the OLED 1, independently of the voltage $V_{DS}$ across the transistor. It is dependent only on the voltage $V_{GS}$.

Figure 4:
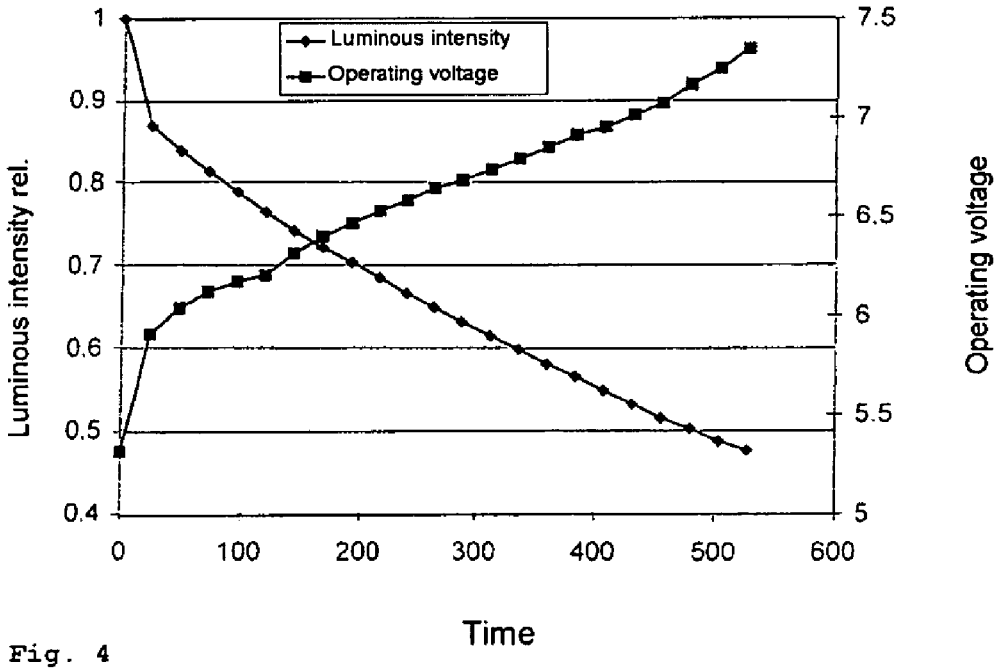
FIG. 4 shows an illustration of the alteration of the luminous intensity and the voltage of the OLED over time.

As illustrated in FIG. 4, it has been shown that with increasing ageing of the OLED 1, given the same current, the brightness decreases and the voltage across the OLED $V_{OLED}$ rises. This results in the two different characteristic curves 9 and 10. It thus becomes possible to deduce the ageing state of the OLED 1 with the aid of the characteristic curves 9 and 10.

Figure 5:
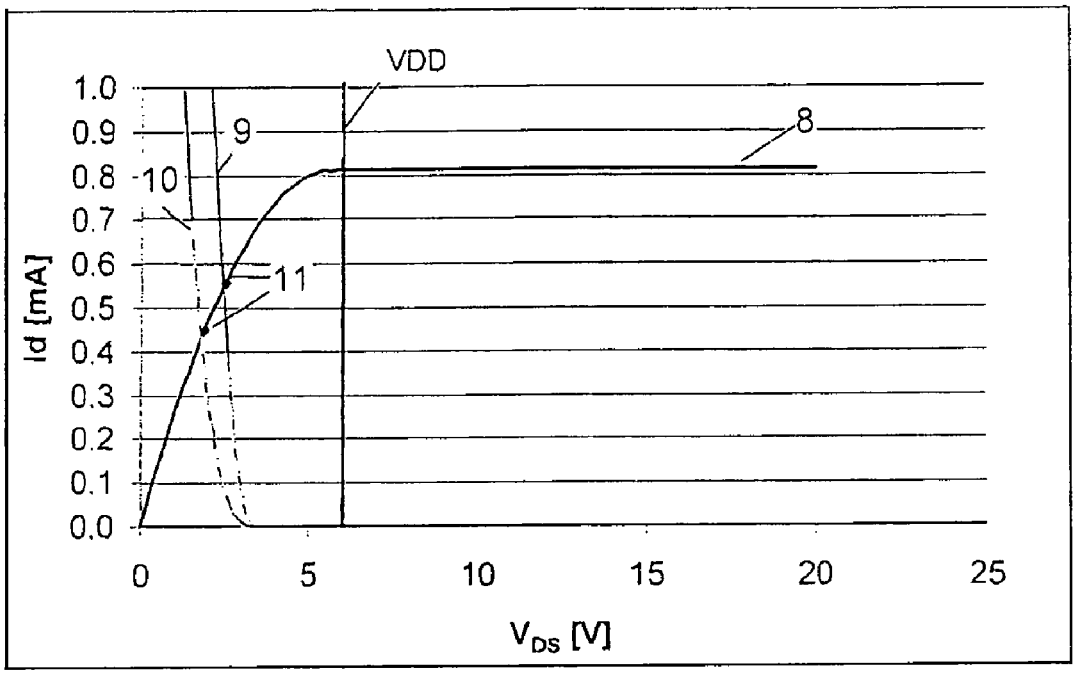
FIG. 5 shows a characteristic curve of a driver transistor in linear operation.

In order to determine said ageing state, the supply voltage $V_{DD}$ is then set in such a way that the driver transistor 2 operates in the linear region, that is to say that there is a dependence of the voltage $V_{DS}$ on the current $I_D$ as is illustrated in FIG. 5. Consequently, $V_{DS}=f(V_{GS}; I_D)$ holds true. The linear region of the transistor is attained if $V_{GS} \geqq V_{DS}+V_t$ holds true, where $V_t$ represents the threshold voltage of the driver transistor 2.

In order to operate reliably in the linear region, $V_{GS}$ is chosen to be as large as possible in accordance with the circuitry possibilities, that is to say $V_{GS}=V_{GSmax}$. The supply voltage $V_{DD}$ is then set in such a way that the driver transistor 2 lies outside its saturation region, that is to say $V_{DD}<V_{DSsat}+V_{OLED}$, where $V_{DSsat}=V_{GS}-V_t$ represents the saturation voltage of the driver transistor 2 for a given gate voltage.

With the relationship $V_{OLED}=V_{DD}-V_{DS}$ it is then possible to determine the voltage across the OLED 1 and thus its ageing state. For this purpose, the current $I_D$ is measured and the voltage $V_{DS}$ is calculated from the known values of the supply voltage, the gate voltage and the transistor parameters. This in turn is used to determine the voltage value $V_{OLED}$.

The knowledge of the voltage across the OLED 1 is suitable for determining the current-voltage value pair, that is to say the operating point 11, which unambiguously identifies the characteristic curve 10 associated with it and thus describes the ageing state of the OLED 1. In FIG. 3 and FIG. 5, a characteristic curve corresponding to a specific ageing state was shown by way of example by means of the characteristic curve 10.

In order to eliminate the influence of leakage currents in the display matrix, two measurements are required with the same low supply voltage $V_{DD}$. A current measurement of the current $I_{Doff}$ is performed once when all the pixels have been switched off. The current $I_{Don}$ is then measured with one pixel at $V_{GSmax}$. The difference produces the current through the OLED 1 $I_{Don}-I_{Doff}=I_D$. In an active matrix with very low off currents, the measurement of the off current $I_{Doff}$ may also be omitted. A comparison of the $I_D$ established with the stored value in the non-aged state of the OLED 1 then allows the conclusion to be drawn about the ageing state.

The measurements can typically only be carried out separately for each OLED. In any event, only one current measuring circuit 7 is required for the entire display, which circuit does not, however, have to be situated on the matrix, so that the circuitry outlay of the matrix is not increased. However, it is also possible to perform an average measurement of the current for all the pixels simultaneously if all the pixels have approximately the same ageing state and all the driver transistors of a matrix have the same characteristic curve. The average ageing state of all the OLEDs is then determined by means of a current measurement for the entire matrix according to the same method as described above.

The threshold voltage of the driver transistor that is required for calculating the voltage $V_{DS}$ in linear operation can be determined by measuring the current through the OLED for two different gate voltages in saturation operation of the transistor. The current in saturation operation is calculated according to the formula:

$$I_{DSat} = \frac{k}{2}(V_{GS} - V_t)^2.$$

The measurement of $I_{DSat1}$, the current through the driver transistor with the gate voltage $V_{GS1}$, is effected at $V_{GS1}=V_{GS}$, and that of $I_{DSat2}$, the current with a second gate voltage $V_{GS2}$, is effected at $V_{GS2}=V_{GS}+\Delta V_{GS}$. The threshold voltage is then calculated as:

$$V_t = \frac{\Delta V_{GS}}{1 - \sqrt{\frac{I_{DSat2}}{I_{DSat1}}}} + V_{GS}.$$

It is thus also possible to determine the ageing of the OLEDs with altered threshold voltages of the driver transistors which occur due to ageing thereof. In addition, it is possible to compensate for parameter fluctuations of the transistors.

The currents $I_{DSat1}$ and $I_{DSat2}$ are also referred to hereinbelow as $I_{Don1}$ and $I_{Don2}$.

By measuring one current-voltage value pair per OLED, it is possible to carry out a simple and rapid determination of the ageing state of the OLED. If a higher accuracy is required, this may be effected by measuring two or more value pairs per OLED. In this case, either the gate voltage of the driver transistor or the supply voltage $V_{DD}$ is to be altered, as a result of which the current $I_D$ established is concomitantly altered in both cases. The characteristic curve segment thus measured can be used by way of example to perform an adaptation of the gamma correction. The increased time taken has a disadvantageous effect, for which reason this multi-point method is to be performed less often. However, since the ageing of the OLEDs has a greater effect on the brightness impression of the display and the uniformity thereof than on the gamma impression, the multi-point method may be used for additional quality enhancement and the simple single-point method may be used for the principal compensation.

The features of the invention disclosed in the above description, the claims and the drawings may be of importance both individually and in any desired combination for realizing the invention in its various embodiments.

The invention claimed is:

1. Method for the ageing compensation of an organic light-emitting diode (OLED) which is fed from a supply voltage and is switched by means of a driver transistor operated in saturation operation, by means of a driving of the light-emitting diode, the method comprising the following steps of:

storing at least one desired current-voltage value pair of a desired current-voltage characteristic curve of the light-emitting diode, transferring the driver transistor from saturation operation to linear operation during a measurement cycle, measuring a current value for the current through the light-emitting diode by means of a current measuring circuit in the measurement cycle, determining at least one present current-voltage value pair of a present current-voltage characteristic curve of the light-emitting diode by means of the measured current value, comparing the at least one present current-voltage value pair of the light-emitting diode with the desired current-voltage value pair of the light-emitting diode, generating driving parameters for driving the light-emitting diode in a manner dependent on the result of the comparison, characterized in that the ageing compensation is implemented in a display having a multiplicity of display elements which are formed by a circuit, comprising an OLED, driver transistor, and driving transistor wherein a supply voltage $V_{DD}$ is reduced to an extent such that the driver transistors of the plurality of light-emitting diodes are transferred from saturation operation to linear operation, wherein all of the plurality of light-emitting diodes are switched off before one of the plurality of light-emitting diodes which is to be measured is switched on and for an associated driver transistor of the light-emitting diode which is to be measured the source-drain current $I_{Donlinear}$ through the display supply line is measured, the source-drain voltage of the associated driver transistor for the light-emitting diode which is to be measured is determined by means of the characteristic curve of the associated driver transistor, the gate voltage and the measured source-drain current, a forward voltage value for the light-emitting diode which is to be measured is calculated from the difference between the supply voltage and the calculated source-drain voltage, and a characteristic curve alteration is determined from the comparison of the desired current-voltage value pair with the present current-voltage value pair for the light-emitting diode which is to be measured.

2. Method according to claim 1, characterized in that the driving parameters are stored in a memory until the ageing is determined anew.

3. Method according to claim 1, characterized in that the ageing compensation is implemented in a display having a matrix of a plurality of light-emitting diodes (OLEDs), in which case all of the plurality of light-emitting diodes of the matrix are switched off during the measurement cycle, a total current $I_{Doff}$ of the matrix through a display supply line is measured, afterwards, one of the plurality of light-emitting diodes which is to be measured and an associated driver transistor are switched on, for the light-emitting diode which is to be measured and the associated driver transistor, two measurements of the current in saturation operation of the driver transistor, $I_{Don1}$ and $I_{Don2}$, at two different gate voltages $U_{GS1}$, $U_{GS2}$, are carried out, and a threshold voltage of the associated driver transistor for the light-emitting diode which is to be measured is calculated from the total current $I_{Doff}$, the currents $I_{Don1}$, $I_{Don2}$ and the gate voltages $U_{GS1}$, $U_{GS2}$.

4. Method according claim 1, characterized in that after the plurality of light-emitting diodes have been switched off a dark current $I_{Dofflinear}$ through the display supply line is measured.

5. Method according to claim 1, characterized in that, by multiple application of the method with alteration of the gate voltage of the associated driver transistor, a characteristic curve segment of the OLED characteristic curve is recorded and this characteristic curve segment is subsequently used for more precise compensation of the ageing.

6. Method according to claim 1, characterized in that, by multiple application of the method with alteration of the supply voltage $V_{DD}$, a characteristic curve segment of the OLED characteristic curve is recorded and this characteristic curve segment is subsequently used for more precise compensation of the ageing.

7. Method according to claim 1, characterized in that the ageing compensation is carried out upon every turn-on.

8. Method according to claim 1, characterized in that a brightness compensation of the light-emitting diode is carried out with the aid of the driving.

9. Method according to claim 1, characterized in that a gamma correction adaptation of the plurality of light-emitting diodes of the matrix is carried out with the aid of the driving.

10. Circuit arrangement for carrying out the method according to claim 1 having a circuit, having a light-emitting diode (OLED) connected together with a drain-source path of a driver transistor, the gate of which is connected to a driving transistor, in a current path between a supply voltage $V_{DD}$ and earth, and having a driving circuit connected to the circuit in a manner driving the latter, characterized in that a current measuring circuit is connected into the current path.

11. Circuit arrangement according to claim 10, characterized in that the current measuring circuit is arranged between a terminal of the supply voltage $V_{DD}$ and the light-emitting diode.

12. Circuit arrangement according to claim 10, characterized in that the circuit is arranged multiply in rows and columns of a display matrix, all circuits having a common connection to the supply voltage $V_{DD}$, and in that the current measuring circuit is located in the common connection of the circuits to the supply voltage $V_{DD}$.

13. Circuit arrangement according to claim 12, characterized in that the current measuring circuit is arranged spatially in or at the driving circuit.

14. Circuit arrangement according to claim 12, characterized in that the current measuring circuit is arranged spatially on a substrate of the display matrix.

* * * * *

UNITED STATES PATENT AND TRADEMARK OFFICE

CERTIFICATE OF CORRECTION

PATENT NO. : 7,656,370 B2
APPLICATION NO. : 11/231329
DATED : February 2, 2010
INVENTOR(S) : Schneider et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 874 days.

Signed and Sealed this

Twenty-eighth Day of December, 2010

David J. Kappos

David J. Kappos
*Director of the United States Patent and Trademark Office*